US008245511B2

(12) United States Patent
Cowland et al.

(10) Patent No.: US 8,245,511 B2
(45) **Date of Patent: *Aug. 21, 2012**

(54) CYLINDER BLOCK MOUNTED PEDESTAL AND TURBOCHARGER SYSTEM FOR INTERNAL COMBUSTION ENGINE

(75) Inventors: Christopher Cowland, Dexter, MI (US); Patrick Sexton, Ypsilanti, MI (US); Christopher Kelly Palazzolo, Ann Arbor, MI (US); Anthony William Hudson, Highland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 988 days.

This patent is subject to a terminal disclaimer.

(21) Appl. No.: 12/145,896

(22) Filed: Jun. 25, 2008

(65) Prior Publication Data

US 2009/0320472 A1 Dec. 31, 2009

(51) Int. Cl.
*F02G 3/00* (2006.01)
*F02B 33/44* (2006.01)

(52) U.S. Cl. ..... 60/624; 60/605.3

(58) Field of Classification Search ..... 184/6.11, 184/6.16, 624; 60/605.3; 123/195 A, 54.4; 277/591, 594, 596, 598, 637; 415/213.1
See application file for complete search history.

(56) References Cited

U.S. PATENT DOCUMENTS 4,405,138 A * 9/1983 Skrycki ..... 277/591
4,469,078 A * 9/1984 Speer et al. ..... 123/564
4,483,147 A * 11/1984 Evans et al. ..... 60/611
4,583,367 A * 4/1986 Kapfer et al. ..... 60/605.3
4,643,137 A 2/1987 Choushi
4,716,735 A * 1/1988 Ruf et al. ..... 60/605.3
5,079,921 A 1/1992 McCandless
5,139,349 A 8/1992 Nakano
5,392,604 A * 2/1995 Nikula et al. ..... 60/605.3
5,392,751 A * 2/1995 Matsubara et al. ..... 123/559.1
5,544,486 A * 8/1996 Lu ..... 60/599
6,125,799 A 10/2000 Van Son
6,305,168 B1 * 10/2001 Furukawa ..... 60/605.1
6,484,683 B2 11/2002 Zielke
6,915,634 B2 * 7/2005 Dumas et al. ..... 60/605.3
7,043,915 B2 * 5/2006 Anello ..... 60/605.3

(Continued)

FOREIGN PATENT DOCUMENTS

CN 101614151 A 12/2009

(Continued)

OTHER PUBLICATIONS

Office Action of Chinese Application No. 200910139674.9, Issued Jun. 11, 2012, State Intellectual Property Office of PRC, 2 Pages.

*Primary Examiner* — Thomas Denion
*Assistant Examiner* — Cameron Setayesh
(74) *Attorney, Agent, or Firm* — Julia Voutyras; Alleman Hall McCoy Russell & Tuttle LLP

(57) ABSTRACT

A turbocharger system for an internal combustion engine includes a turbocharger with a utility pedestal extending between the turbocharger and hard point associated with the cylinder block. The utility pedestal includes a mounting pad for attaching the combined turbocharger and pedestal assembly to an engine, as well as internal oil and coolant supply passages for supplying the turbocharger with coolant and lubricating oil under pressure.

20 Claims, 6 Drawing Sheets

U.S. PATENT DOCUMENTS

| | | | | |
|---|---|---|---|---|
| 7,165,402 | B2 * | 1/2007 | Blom | 60/605.3 |
| 7,784,442 | B2 * | 8/2010 | Lester et al. | 123/193.5 |
| 2001/0048062 | A1 | 12/2001 | Murao | |
| 2005/0257521 | A1 | 11/2005 | Anello | |
| 2007/0056281 | A1 * | 3/2007 | Arvan et al. | 60/598 |
| 2007/0175456 | A1 | 8/2007 | Tally | |
| 2007/0234997 | A1 | 10/2007 | Prenger | |
| 2008/0223329 | A1 * | 9/2008 | Preimesberger et al. | 123/195 A |
| 2009/0078240 | A1 * | 3/2009 | Diggs et al. | 123/559.1 |
| 2009/0095875 | A1 * | 4/2009 | Anello | 248/637 |
| 2009/0320469 | A1 * | 12/2009 | Palazzolo et al. | 60/624 |
| 2011/0023800 | A1 * | 2/2011 | Ives et al. | 123/54.4 |

FOREIGN PATENT DOCUMENTS

| | | | |
|---|---|---|---|
| DE | 10218354 | A1 | 11/2003 |
| GB | 2424450 | A | 9/2006 |

* cited by examiner

CYLINDER BLOCK MOUNTED PEDESTAL AND TURBOCHARGER SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to a turbocharger system including not only a turbocharger, but also a mounting pedestal arranged with utilities needed to operate and position the turbocharger. The mounting pedestal is attached to the cylinder block of an engine and is connected with various utilities integrated within a mounting pad associated with the cylinder block.

2. Related Art

Turbocharging has been used for a number of years with internal combustion engines. Although early turbochargers were often cooled primarily by air, as well as by the flow of oil through the turbocharger's bearings, later model turbochargers, especially larger turbochargers and those installed in heavy duty engines, generally utilize coolant circulating from the engine's cooling system through the turbo, and then back to the engine's main cooling system.

Turbochargers also require oil supply and drain utilities to lubricate bearings incorporated within the turbocharger. Needless to say, the provision of a source of coolant and a source of oil, with both being under pressure, as well as draining the oil and coolant from the turbocharger and returning these fluids separately to the engine, has necessitated a good deal of plumbing. Usually, this plumbing takes the form of external hoses and fittings. Unfortunately, external fluid connections and associated pipes and hoses cause problems because hoses and fittings are known to leak and are subject to damage accelerated by the high temperatures prevailing within engine compartments. Moreover, aside from durability issues, the need for external plumbing for turbochargers increases the space required by the turbocharger in an already crowded underhood environment.

Turbochargers mounted on engines typically consume a good deal of space for another reason. Because known mounting arrangements are not susceptible to locating the turbocharger close to the engine block, turbochargers must be spaced away from the engine to permit the insertion of the turbochargers' fasteners. U.S. Pat. No. 6,125,799 discloses a bulky mounting system relying in part upon external utilities to the extent that mounting a turbochargers is recommended only on the extreme front or back of an engine. Moreover, other known turbocharger mounting systems increase radiated noise because of a lack of rigidity and because of the dimensional problems associated with their usage.

It would be desirable to provide a turbocharger, including a mounting system having integral supply and return passages for coolant and lubricating oil and communicating directly with utility passages within a hard point associated with a cylinder block.

BRIEF DESCRIPTION OF THE INVENTION

According to an aspect of the present invention, a turbocharger system for an internal combustion engine having a cylinder block includes a turbocharger and a utility pedestal extending between the turbocharger and a hard point associated with the cylinder block. The utility pedestal includes a mounting pad for the pedestal and an oil supply passage for conveying lubricating oil under pressure from the cylinder block to the turbocharger. A return oil passage conveys lubricating oil from the turbocharger to a lubrication system incorporated within the engine. A coolant supply passage conveys coolant under pressure to the turbocharger, and a coolant return passage, configured at least in part within the utility pedestal, conveys coolant from the turbocharger to a cooling system incorporated within the engine. According to another aspect of the present invention, the coolant return passage may include a passage configured, at least in part, within the engine's cylinder block, as well as within the utility pedestal.

According to another aspect of the present invention a coolant return passage from the turbocharger may be configured so as to convey the coolant to a mixing chamber within which the coolant from the turbocharger is mixed with coolant flowing from at least one cylinder head.

According to another aspect of the present invention, a return oil passage from the turbocharger conveys waste oil from the turbocharger to a crankcase sump without allowing the waste oil to contact moving parts within the engine.

According to another aspect of the present invention, a hard point associated with the cylinder block for mounting the turbocharger includes a generally planar mounting pad configured on a portion of the cylinder block, with the mounting pad of the utility pedestal having a lower mating surface matched to the generally planar mounting pad. The cylinder block's mounting pad is configured with lubricating oil and coolant utilities.

According to another aspect of the present invention, a turbocharger's generally planar mounting pad may be configured upon a cylinder block within a valley defined by the cylinder banks of a V-block engine.

According to yet another aspect of the present invention, the turbocharger pedestal mounting pad of the utility pedestal comprises a number of mounting bosses having fastener bores extending therethrough at an acute angle with respect to a horizontal plane such that fasteners inserted within the bores pass inboard to threaded bores formed in a hard point associated with the cylinder block.

According to another aspect of the present invention, the return, or waste, oil passage extending from the turbocharger and through the utility pedestal is designed to prevent foamed or frothed oil flowing from the turbocharger from impairing engine lubrication. This is accomplished by preventing the waste oil from contacting moving parts within the engine as the oil flows back to the crankcase sump.

It is an advantage of the present turbocharger system that the turbocharger and pedestal may be assembled at one geographic location and installed upon an engine as a single unit at a second geographic location without the need for making external utility connections for lubricating oil and water feeds and drains.

It is another advantage of a turbocharging system according to the present invention that the present turbocharger system, including the turbocharger, a utility pedestal, and a cylinder block mounting pad communicating oil and coolant utilities to the pedestal, functions as a very compact mounting system for attaching the turbocharger system directly to the cylinder block of an internal combustion engine.

It is yet another advantage of a turbocharging system according to the present invention that the noise signature of the turbocharger will be reduced because of the stiffness inherent with the close mounted utility pedestal and cylinder block mounting pad featured in the present invention.

It is yet another advantage of the present invention that the fasteners used to mount the pedestal to the engine may be accessed without removing portions of the turbocharger.

Other advantages, as well as features of the present invention, will become apparent to the reader of this specification.

DETAILED DESCRIPTION OF THE PREFERRED EMBODIMENTS

Figure 1:
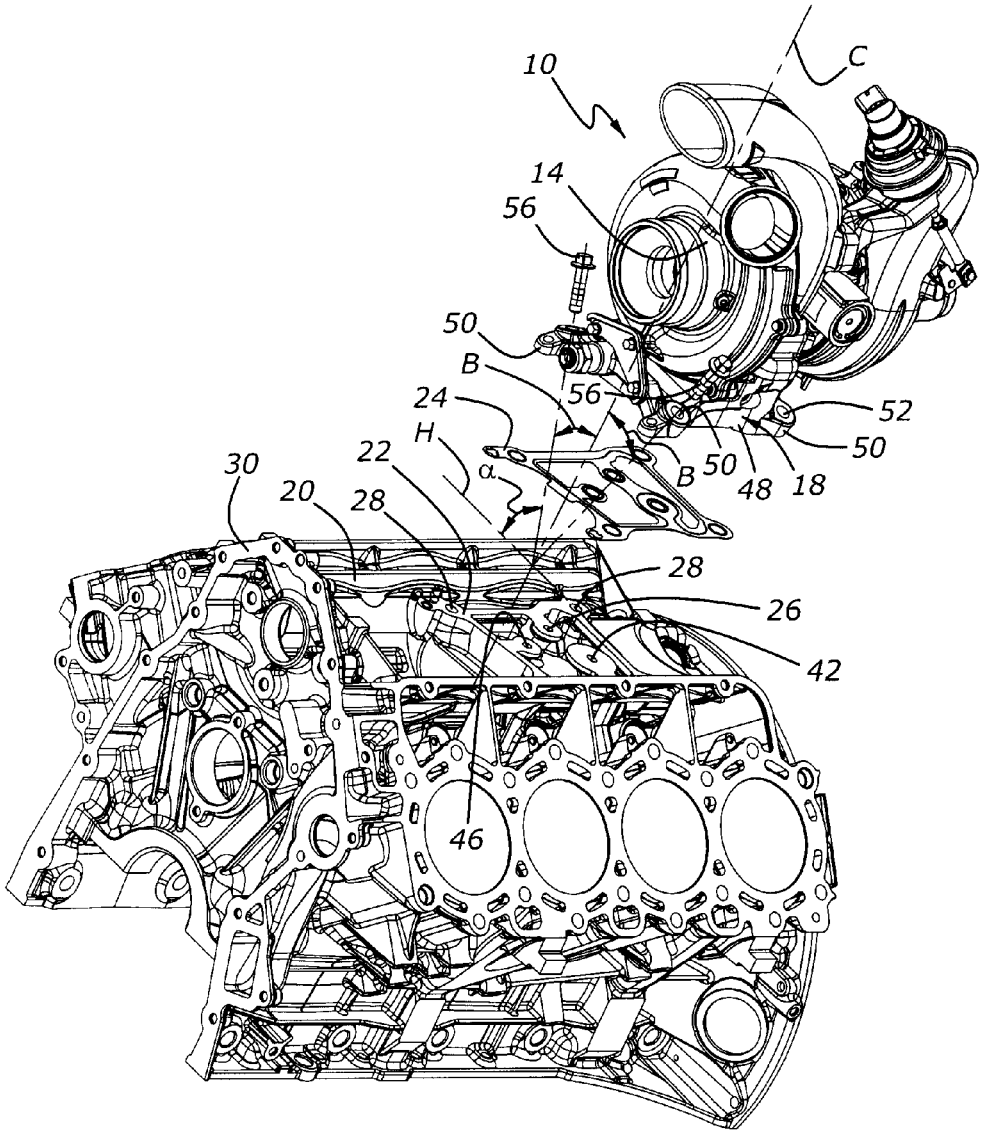
FIG. 1 is an exploded perspective view of an engine having a turbocharger system according to the present invention.

As shown in FIG. 1, turbocharger system 10 includes a turbocharger, 14, and a utility pedestal 18. Turbocharger 14 is preferably mounted to utility pedestal 18 before turbocharger 14 is mounted upon an engine. FIG. 1 also shows an engine cylinder block, 30, having a valley, 20, into which turbocharger system 10 is placed upon a hard point, which is illustrated as a generally planar turbocharger mounting pad, 22, which is one piece with cylinder block 30. Utility pedestal 18 provides rigid structural support for turbocharger 14; this helps to reduce unwanted engine noise emissions, as well as reducing unwanted vibration associated with the turbocharger. Those skilled in the art will appreciate in view of this disclosure that the term "hard point", as used herein means either a structurally rigid mounting location such as block pad 22 machined into the parent metal of a cylinder block, or a separate pad or bracket, such as that illustrated at 100 in FIG. 6. Mounting pad 100 is intended to be attached to an engine by bolting, or welding, or by some other suitable process.

Utility pedestal 18 has a mounting pad, 48, at its lower extremity. Mounting pad 48 includes mounting bosses 50, which have fastener bores 52. Fastener bores 52 extend through mounting bosses 50 and make an acute angle, $\alpha$, with a horizontal plane, H (FIG. 1). Fastener bores 52 allow the passage of a number of threaded fasteners, 56, which pass through fastener bores 52 and into threaded bores, 28, formed in generally planar mounting pad 22 of cylinder block 30. Two of threaded bores 28 are shown in FIG. 1. FIG. 1 further shows that mounting bosses 50 are angled so that threaded fasteners or bolts 56 extend inboard into bolt holes 28 formed in mounting pad 22 of cylinder block 30. This geometry is also shown in FIG. 2.

Figure 2:
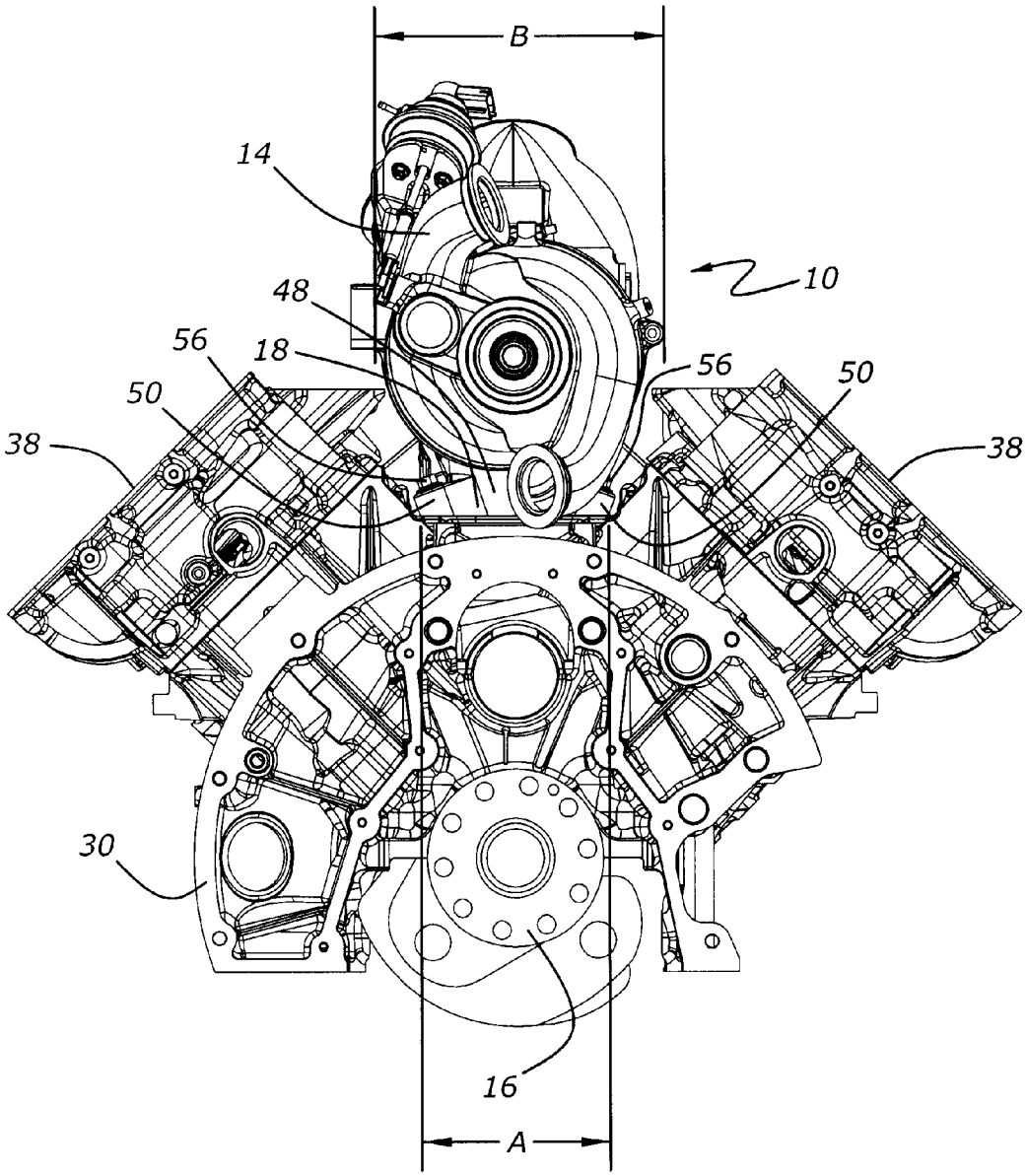
FIG. 2 is an end view, partially cut away, of a portion of an engine having a turbocharger system according to the present invention.

As seen in FIG. 2, the width, A, of utility pedestal mounting pad 48 is less than the overall width, B, of turbocharger 14. This is an added benefit stemming from the angular orientation of fastener bores 52, which fortuitously permit turbocharger 14 and utility pedestal 18 to be disassembled as one unit from the engine without removing portions of the turbocharger assembly. The angles of fastener bores 52 also allow turbocharger 14 to be mounted closer to cylinder block 30, in a vertical direction closer to crankshaft 16. FIG. 2 shows turbocharger 14 nestled in valley 20 between cylinder heads 38 and cylinder block 30.

Figure 3:
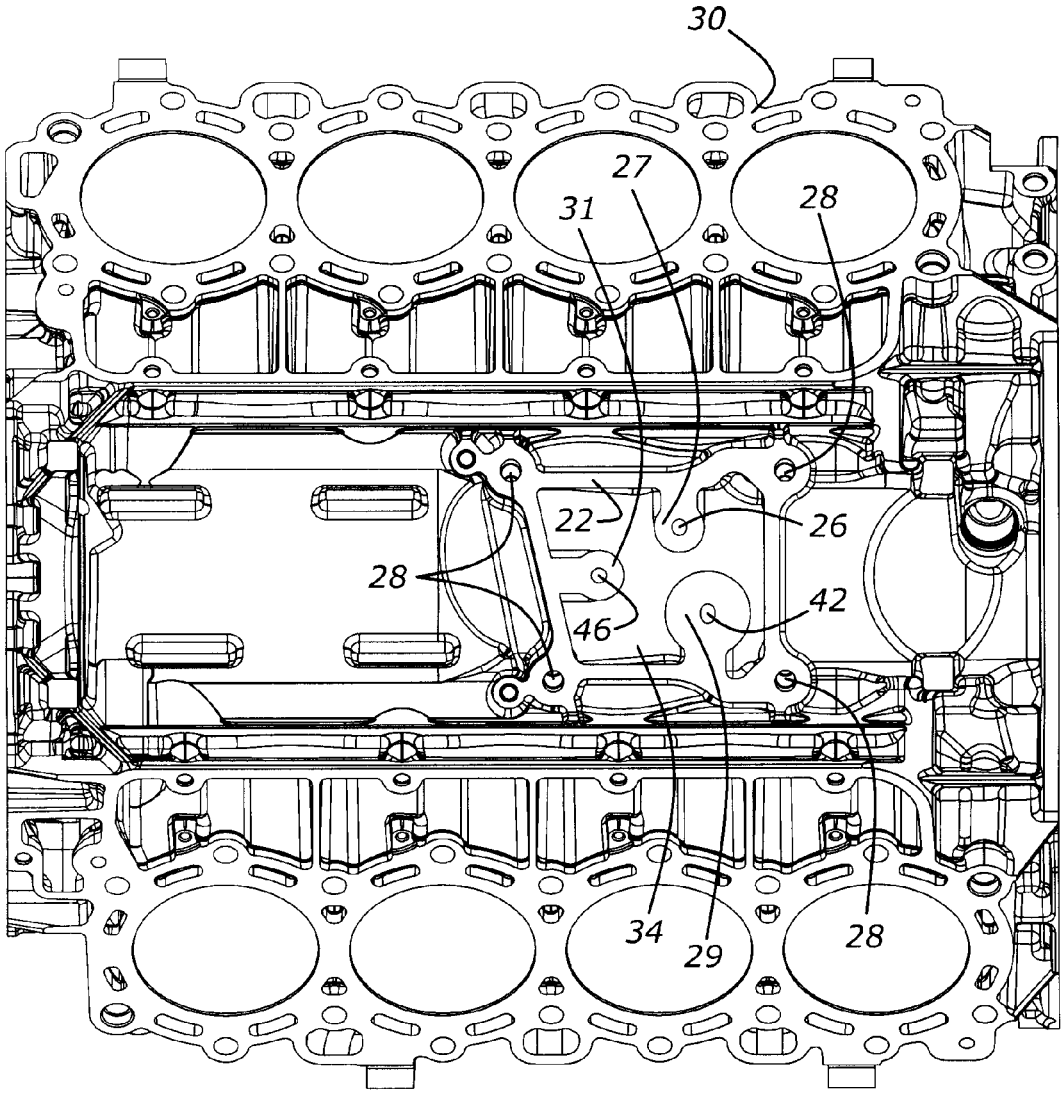
FIG. 3 is a plan view of an engine block showing a turbocharger pedestal mounting pad and utility passages for lubricating oil and coolant according to an aspect of the present invention.
Figure 4:
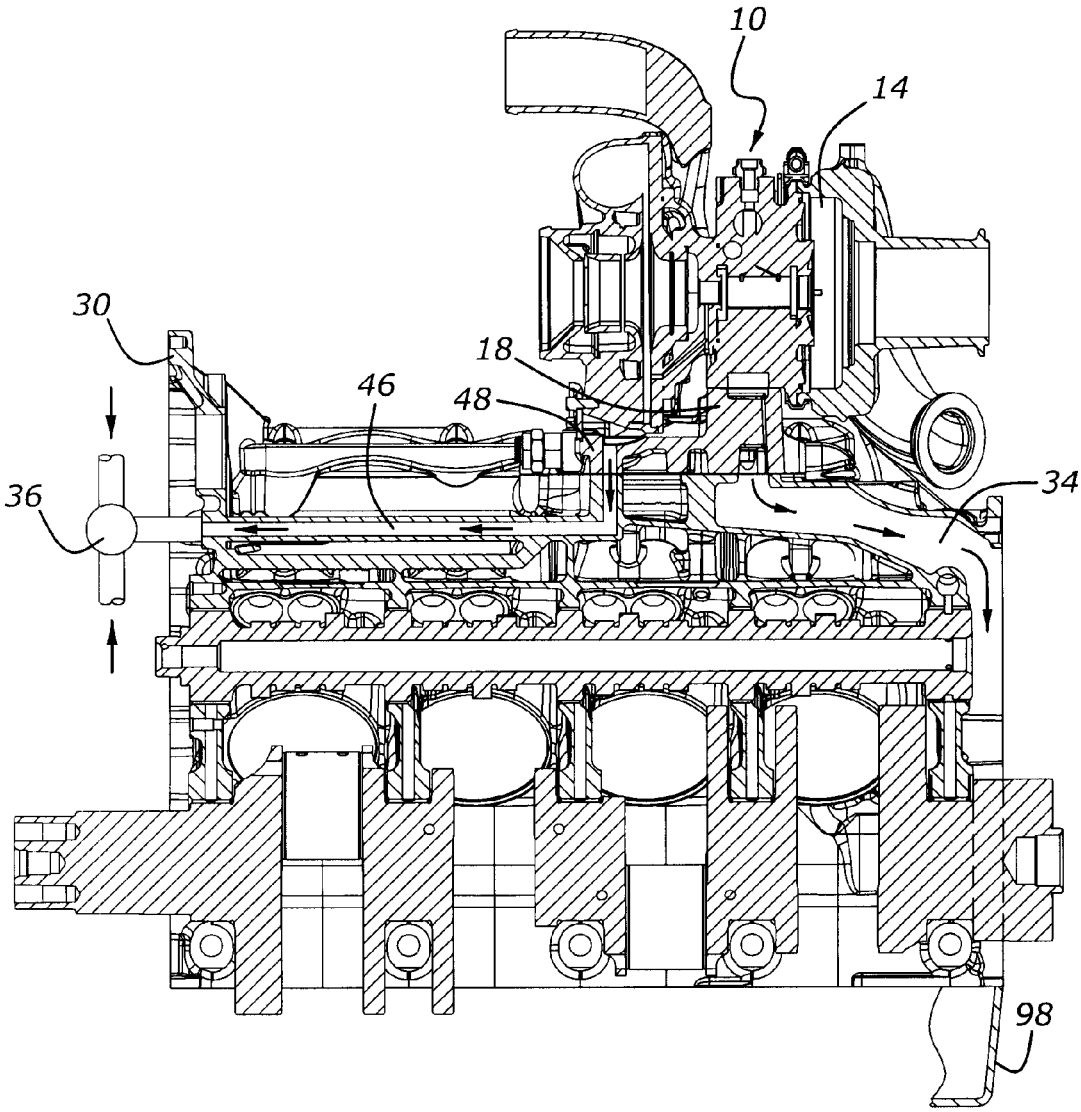
FIG. 4 is a side elevation, partially cut away, of an engine having a turbocharger system according to the present invention and showing the routing for several of the utility passages for oil and water according to the present invention.
Figure 5:
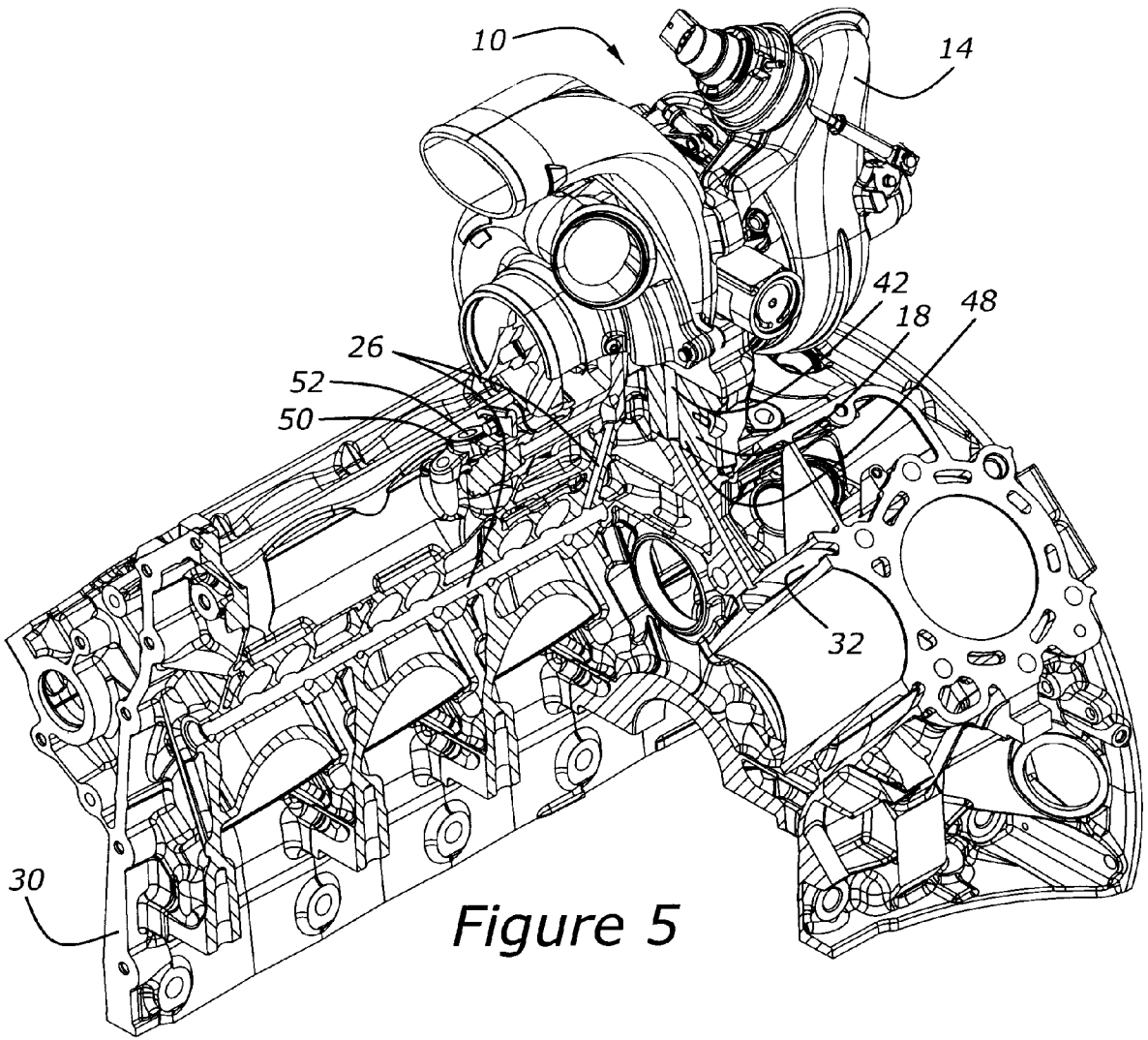
FIG. 5 is a side perspective view, partially cut away, of an engine having a turbocharger system according to the present invention.

FIG. 3 shows generally planar mounting pad 22 as being located in the mid-portion of the valley of cylinder block 30. Several of threaded mounting bolt holes 28 are shown. FIGS. 3, 4, and 5 further illustrate lubrication and cooling utilities for turbocharger 14. The first such utility, oil supply passage 26, is shown as extending through a lubrication port formed within the planar surface of mounting pad 22 within a boss, 27, and upwardly into utility pedestal 18 from within cylinder block 30.

Coolant supply passage 42, which is formed in part as a coolant port within a boss, 29, also communicates with the planar surface of mounting pad 22, as does coolant return 46, which is formed within a third boss, 31. FIG. 5 shows coolant supply passage 42, which extends into utility pedestal 18 from an engine water jacket, 32. Water leaving turbocharger 14 flows through coolant return passage 46 (FIG. 4) down through utility pedestal 18 and out to the front of engine block 30, wherein the flow is joined with coolant flow from one or more cylinder heads at a combination point 36. Coolant return passage 46 may advantageously be configured as a cored passage within cylinder block 30. Those skilled in the art will appreciate, in view of this disclosure that combination point 36 could be configured as a water outlet or coolant surge tank or other device for combining coolant flows from more than one source, such as one or more of the engine's cylinder heads. This combination of flows offers the advantage of mitigating coolant temperature excursions which could otherwise result from the very warm coolant leaving turbocharger 14.

Because the upper machined surfaces of bosses 27, 29, and 31 corresponding with internal oil supply passage 26, internal coolant supply passage 42, and internal coolant return passage 46, respectively, are all co-planar with the uppermost surface of mounting pad 22, all of these utilities may be sealed to utility pedestal 18 with a single gasket 24, which is shown in FIG. 1. Gasket 24 is illustrated as a unitary carrier incorporating a number of integral o-rings for sealing passages 26, 42, and 46. The use of a single gasket carrier, equipped with a number of integral o-ring seals, and coplanar passages, allows a leak-tight seal to be made very quickly and accurately, without excessive labor or component expense. Those skilled in the art will appreciate in view of this disclosure that a hard point for mounting utility pedestal 18 may be configured not only within the parent metal of cylinder block 30, but alternatively within adapter 100 having various utility passages, as well as threaded fastener bores akin to the illustrated bores 28 provided in mounting pad 22.

Figure 6:
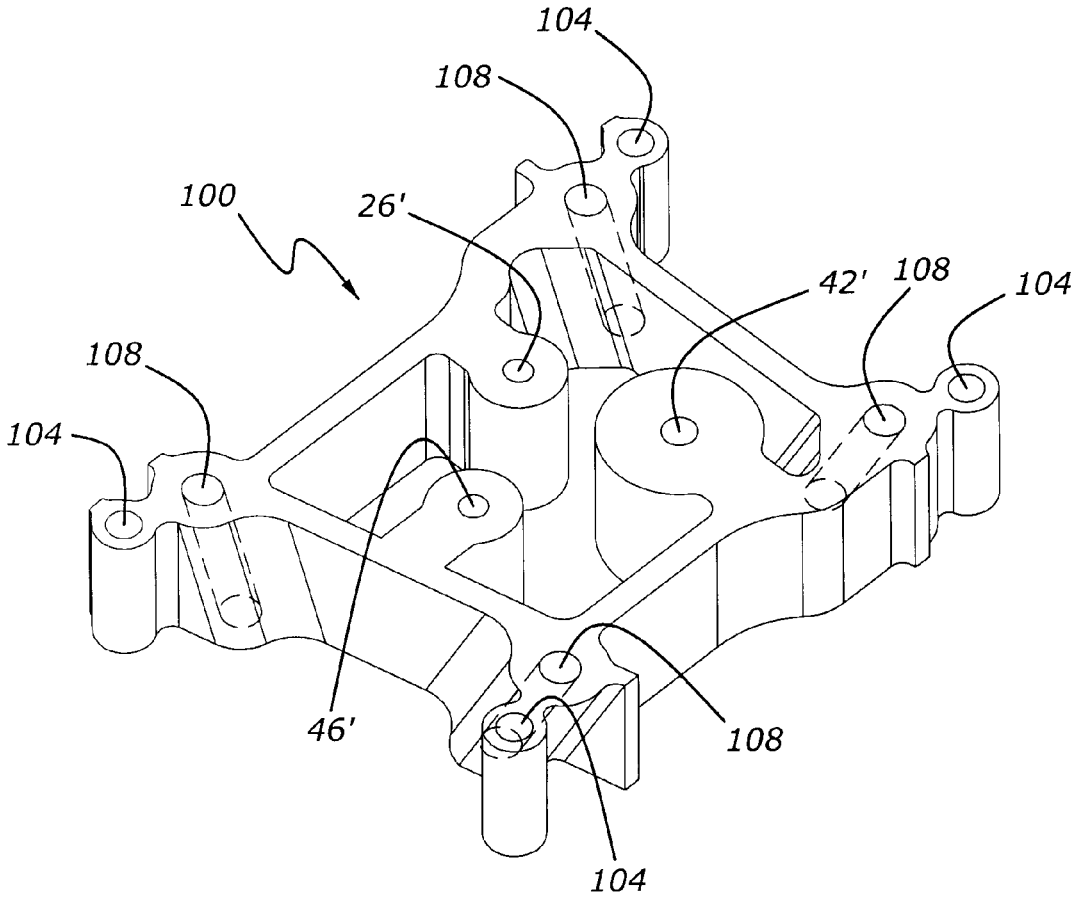
FIG. 6 is a perspective view of a turbocharger mounting hard point configured as a plate suitable for bolting or welding to an engine cylinder block.

In the event that a separate mounting pad or plate is employed, such as that illustrated at 100 in FIG. 6, a number of fastener bores, 108, will be provided in the same manner as bores 52. Adapter plate 100 also contains fluid passages 26', 42', and 46', which perform the functions ascribed to passages 26, 42, and 46, respectively. Plate 100 may be fastened to an engine by means of threaded fasteners extending through bores 104, or by welding or other known methods.

Only the uppermost part of return oil isolation passage 34 within cylinder block 30 is shown in FIG. 3; for more definition, one must look to FIG. 4, wherein return oil passage 34 is shown as leading to the one end of engine block 30 and down into crankcase sump 98 in a region in which there are no rotating or moving parts. As noted above, the drainback of waste oil from turbocharger 14 to crankcase sump 98 through areas of the engine devoid of moving parts prevents galling or overheating of such moving parts by preventing contact between parts needing lubrication and temporarily aerated oil.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A turbocharger system for an engine having a cylinder block, comprising:

a turbocharger; and a utility pedestal fastened to the turbocharger and mounted to a hard point that extends laterally between opposing cylinder banks and is located on a mid-portion of the cylinder block, with said utility pedestal comprising:

a mounting pad located at a lower extremity of the pedestal for mounting the pedestal to the hard point;

an internal oil supply passage for conveying lubricating oil under pressure, from an internal lubrication passage in the cylinder block through the hard point, to the turbocharger; and an internal coolant supply passage for conveying coolant under pressure, from an internal coolant passage in the cylinder block through the hard point, to the turbocharger.

2. A turbocharger system according to claim 1, wherein said hard point comprises a generally planar mounting pad configured on a portion of the cylinder block, with the mounting pad of the utility pedestal having a lower mating surface matched to the generally planar mounting pad of the hard point.

3. A turbocharger system according to claim 2, wherein said generally planar mounting pad is one piece with the cylinder block.

4. A turbocharger system according to claim 2, wherein said generally planar mounting pad comprises an adapter plate attached to the cylinder block.

5. A turbocharger system according to claim 2, wherein said generally planar mounting pad is configured upon an upper portion of the cylinder block.

6. A turbocharger system according to claim 2, wherein said generally planar mounting pad is configured within a valley defined by the opposing cylinder banks of a V-block engine.

7. A turbocharger system according to claim 1, wherein said pedestal mounting pad comprises a plurality of mounting bosses having fastener bores extending therethrough at an acute angle with respect to a horizontal plane, such that fasteners inserted within the bores pass inboard to threaded bores formed in the hard point.

8. A turbocharger system according to claim 1, further comprising a coolant return passage configured, at least in part, within said utility pedestal for conveying coolant from the turbocharger to a cooling system incorporated within the engine.

9. A turbocharger system according to claim 1, wherein said hard point associated with the cylinder block comprises a generally planar mounting pad configured with a plurality of ported bosses for communicating with said oil supply passage and said coolant supply passage.

10. A turbocharger system according to claim 1, further comprising a return oil passage for conveying waste lubricating oil through a passage extending through the hard point to a lubrication system incorporated within the engine.

11. A turbocharger system according to claim 1, further comprising a gasket interposed between the pedestal mounting pad and the hard point, with said gasket comprising a unitary carrier having a plurality of integral o-ring seals.

12. An engine, comprising:

a V-block configured cylinder block;

a plurality of cylinder heads attached to said cylinder block, with said cylinder heads and said cylinder block defining a valley between the cylinder heads;

a hard point configured upon said cylinder block within said valley, with said hard point comprising a plurality of ported bosses for furnishing lubricating oil and coolant to a turbocharger, the hard point extending laterally between opposing cylinder heads of the cylinder block; and a turbocharger mounted upon a utility pedestal extending between the turbocharger and said hard point with said utility pedestal comprising:

a mounting pad for the pedestal, with said mounting pad having a plurality of mounting bosses with fastener bores extending therethrough at an acute angle with respect to a horizontal plane, such that fasteners inserted within the fastener bores pass inboard and into threaded bores formed within the hard point;

an oil supply passage for conveying lubricating oil under pressure from the cylinder block to the turbocharger, with said oil supply passage being operatively connected with one of said ported bosses furnishing lubricating oil under pressure;

a return oil passage for conveying lubricating oil from the turbocharger to a lubrication system incorporated within the engine; and a coolant supply passage for conveying coolant under pressure to the turbocharger, with said coolant supply passage being operatively connected with one of said ported bosses furnishing coolant under pressure.

13. An engine according to claim 12, further comprising a coolant return passage configured, at least in part, within said utility pedestal for conveying coolant from the turbocharger to a cooling system incorporated within the engine, with said coolant return passage being operatively connected with a ported coolant return boss configured within the hard point.

14. An engine according to claim 12, further comprising a gasket interposed between the pedestal mounting pad and the hard point, with said gasket comprising a unitary carrier having a plurality of integral o-ring seals.

15. An engine, comprising:

a V-block configured cylinder block;

a plurality of cylinder heads attached to said cylinder block, with said cylinder heads and said cylinder block defining a valley between the cylinder heads; and a turbocharger mounted upon a utility pedestal extending between the turbocharger and a hard point, the hard point configured upon said cylinder block within said valley, with said hard point comprising a plurality of ported bosses for furnishing lubricating oil and coolant to the turbocharger.

16. The engine of claim 15, further comprising:

a turbocharger mounted upon a utility pedestal extending between the turbocharger and said hard point with said utility pedestal having a plurality of mounting bosses with fastener bores extending therethrough at an acute angle with respect to a horizontal plane.

17. The engine of claim 16, further comprising:

fasteners inserted within the fastener bores wherein the fasteners are directed inboard as they pass through fastener bores and into threaded bores formed within the hard point associated with the cylinder block.

18. The engine of claim 15, further comprising:

an oil supply passage for conveying lubricating oil under pressure from the cylinder block to the turbocharger, with said oil supply passage being operatively connected with one of said ported bosses furnishing lubricating oil.

19. The engine of claim 15, further comprising:

a return oil passage for conveying lubricating oil from the turbocharger to a lubrication system incorporated within the engine.

20. The engine of claim 15, further comprising:

a coolant supply passage for conveying coolant under pressure to the turbocharger, with said coolant supply passage being operatively connected with one of said ported bosses furnishing coolant.

* * * * *